United States Patent [19]

McLaughlin et al.

[11] 3,972,804

[45] Aug. 3, 1976

[54] CONTROL OF HYDROGEN/HYDROCARBON MOLE RATIO IN HYDROGEN-CONSUMING PROCESS

[75] Inventors: James H. McLaughlin, La Grange; Walter A. Bajek, Lombard, both of Ill.

[73] Assignee: Universal Oil Products Company, Des Plaines, Ill.

[22] Filed: Dec. 20, 1974

[21] Appl. No.: 534,993

Related U.S. Application Data

[63] Continuation-in-part of Ser. No. 511,403, Oct. 2, 1974.

[52] U.S. Cl. ..... 208/108; 23/253 A; 208/DIG. 1

[51] Int. Cl.[2] ..... C10G 13/02

[58] Field of Search ..... 208/DIG. 1, 108; 23/253 A; 235/151.12, 151.13

[56] References Cited

UNITED STATES PATENTS

| | | | |
|---|---|---|---|
| 3,666,932 | 5/1972 | White | 235/151.12 |
| 3,718,577 | 2/1973 | Nai et al. | 208/108 |
| 3,733,476 | 5/1973 | Hopkins et al. | 235/151.12 |

*Primary Examiner*—Herbert Levine
*Attorney, Agent, or Firm*—James R. Hoatson, Jr.; Robert W. Erickson; William H. Page, II

[57] ABSTRACT

A system for controlling the hydrogen/hydrocarbon mole ratio in a continuous hydrocarbon conversion process in which hydrogen is consumed in a catalytic reaction zone. Applicable to processes in which the reaction zone effluent is separated to provide a liquid product phase and a hydrogen-rich vaporous phase, a portion of the latter being recycled to the catalytic reaction zone, the control system affords improved overall operation in addition to increased catalyst activity and stability. Analyzers are utilized to monitor composition characteristics of the charge stock and liquid product, and the hydrogen concentration of the vaporous phase introduced into the reaction zone. Representative process output signals are transmitted to comparator/computer means which compares the rate of change of the composition characteristics and the hydrogen concentration, and generates additional, comparator output signals which are utilized within the control system for regulating the hydrogen/hydrocarbon mole ratio.

12 Claims, 2 Drawing Figures

CONTROL OF HYDROGEN/HYDROCARBON MOLE RATIO IN HYDROGEN-CONSUMING PROCESS

RELATED APPLICATION

The present application is a Continuation-In-Part of our copending application Ser. No. 511,403, filed Oct. 2, 1974, all of the teachings of which copending application are incorporated herein by specific reference thereto.

APPLICABILITY OF INVENTION

The method for controlling the hydrogen/hydrocarbon mole ratio and the control system encompassed by the inventive concept herein described, are generally applicable to processes for the catalytic conversion of hydrocarbons in a hydrogen-containing atmosphere, in which processes the consumption of hydrogen occurs. Such processes include hydrocracking to produce lower molecular weight hydrocarbons, hydrogenation of olefinic hydrocarbons to produce the corresponding paraffins and hydrorefining (desulfurization) for the purpose of contaminant removal, etc. In all these processes, as in most hydrogen-producing processes such as catalytic reforming, a commonly-practiced technique involves the utilization of a hydrogen-rich vaporous phase recycled to combine with the fresh hydrocarbon charge to the reaction zone. Practical reasons for employing this technique reside in maintaining both the activity and operational stability of the catalytic composite, employed to effect the desired reactions, and the assurance of achieving the desired product slate. The former is more difficult to attain in hydrogen-consuming processes in view of the operating severity generally required. In hydrogen-producing processes, such as catalytic reforming, hydrogen in excess of that required for recycle purposes is recovered and utilized in other processes integrated into the overall refinery. For example, excess hydrogen from a catalytic reforming unit is often employed as make-up hydrogen in a hydrocracking process. Regardless of the particular process, the recycled hydrogen is generally obtained by condensing the reaction zone product effluent, most often at a temperature in the range of about 60°F. to about 140°F., and introducing the thus-cooled effluent into a vapor-liquid separation zone. That portion of the recovered vaporous phase necessary to satisfy the hydrogen requirement within the reaction zone is recycled to combine with the hydrocarbon charge stock prior to the introduction thereof into the reaction zone.

Prior art abounds with hydrocarbon conversion processes wherein a relatively hot reaction zone effluent is condensed and cooled, and introduced into a high pressure separator from which a hydrogen-rich vaporous phase and a normally liquid product phase are recovered. Generally, at least a portion of the vaporous phase is recycled without further treatment, to combine with the charge stock prior to the introduction thereof into the catalytic reaction zone. In some situations, however, usually involving sulfur service, that portion of the vaporous phase to be recycled is treated to remove contaminating influences which would have some adverse effect with respect to the reaction zone environment.

Exemplary of the variety of processes employing this basic technique, and to which the present invention is directed, is the pentane isomerization process disclosed in U.S. Pat. No. 3,131,325 (Cl. 260-683.68). Similarly, U.S. Pat. No. 3,133,012 (Cl. 208-95) illustrates this technique as applied to a catalytic reforming system. In U.S. Pat. No. 3,718,575 (Cl. 208-59), which is directed toward a two-stage hydrocracking process, the reaction product effluent from the second stage is cooled prior to the introduction thereof into a vapor-liquid separation zone; the hydrogen-rich stream therefrom is recycled to the first stage to combine with the charge stock. The present method for regulating the hydrogen/hydrocarbon mole ratio in the combined charge to a catalytic reaction zone, and the control system therefor, are applicable to any hydrocarbon conversion process wherein a hydrocarbon charge stock and hydrogen are reacted in a catalytic reaction zone. Therefore, our invention may be readily integrated, with minor modifications, into processes such as hydrogenation, isomerization, hydrorefining, hydrocracking, hydrodealkylation, dehydrogenation and catalytic reforming, etc.

Exemplary of hydrocracking processes, into which the present invention can be integrated, are those schemes and techniques found in U.S. Pat. Nos. 3,252,018 (Cl. 208-59), 3,502,572 (Cl. 208-111) and 3,472,758 (Cl. 208-59). Hydrocracking reactions are generally effected at elevated pressures of about 500 to about 5,000 psig. Circulating hydrogen is admixed with the charge stock in an amount of about 3,000 to about 50,000 scf./Bbl., inclusive of make-up hydrogen from an external source. The charge stock contacts the catalytic composite, disposed within the hydrocracking reaction zone, at a liquid hourly space velocity of about 0.25 to about 5.0. Since the bulk of the reactions being effected are exothermic in nature, an increasing temperature gradient is experienced as the charge stock-/hydrogen reactant stream traverses the catalyst bed. Catalyst bed temperatures are generally maintained at a maximum in the range of about 700°F. to about 900°F., and are conveniently controlled through the use of conventional quench streams, usually vaporous, directly introduced into the catalyst bed at intermediate loci thereof.

The foregoing, briefly described processes are illustrative of those into which the present invention may be advantageously incorporated. In all such processes, the hydrogen/hydrocarbon mole ratio in the combined feed to the reaction zone constitutes an important operating variable. Changes in feed stock composition characteristics require changes in the hydrogen/hydrocarbon mole ratio in order to maintain acceptable catalyst activity and stability. Furthermore, changes in reaction zone severity (principally temperature and pressure) are required as the product quality and/or quantity changes; however, this also affects the hydrogen/-hydrocarbon mole ratio. Also, variations in the hydrogen/hydrocarbon mole ratio will affect somewhat the product quality and/or quantity. Briefly, in accordance with the present control method, a charge stock composition characteristic is sensed (a product composition characteristic may also be sensed) and the hydrogen concentration within the vaporous phase introduced into the reaction zone with the feed stock is sensed. Appropriate representative output signals are transmitted to a comparator/computer which in turn generates computer output signals which are transmitted as required to adjust reaction zone severity (temperature and pressure), charge stock flow and recycle gas flow in order to regulate the hydrogen/hydrocarbon mole ratio while simultaneously achieving the desired product quality and/or quantity. With respect to hydrogen-consuming processes — i.e., hydrocracking to produce lower molecular weight hydrocarbons — comparator output signals are transmitted, as necessary, to regulate the quantity of make-up hydrogen introduced into the process from an external source and the flow of any required reaction zone temperature quench stream.

OBJECTS AND EMBODIMENTS

A principal object of our invention is to control the hydrogen/hydrocarbon mole ratio in a catalytic hydrocarbon conversion process, and particularly wherein the reactions being effected are hydrogen-consuming. A corollary objective is to maintain catalyst activity and stability while attaining the desired product slate.

Another object is to provide a control system and accompanying method for controlling the hydrogen/-hydrocarbon mole ratio. In conjunction, it is a specific object to offer a method which compensates rapidly for changes in charge stock characteristics and operating parameters, which changes necessitate an adjustment of the hydrogen/hydrocarbon mole ratio within the catalytic reaction zone.

Therefore, in one embodiment, our invention involves a control system for utilization in a continuous hydrocarbon conversion process in which hydrogen is consumed, and wherein (1) a hydrocarbonaceous charge stock and hydrogen are introduced into preheating means having external heat-supplying means operatively associated therewith; (2) the resulting heated charge stock-hydrogen mixture is reacted in a catalytic reaction zone; (3) the resulting reaction zone effluent stream is condensed and separated to provide a liquid phase and a first hydrogen-containing vaporous phase; (4) at least a portion of said first vaporous phase is recycled to said preheating means, in admixture with said charge stock; and, (5) a second hydrogen-containing vaporous phase, from an external source, is introduced into said process, at least a portion thereof is admixed with said first hydrogen-containing vaporous phase and introduced therewith into said preheating means; which control system, for regulating the hydrogen/hydrocarbon mole ratio within said reaction zone, comprises, in cooperative combination: (a) first flow-varying means, operatively associated with said preheating means, for adjusting the quantity of heat supplied thereto; (b) first flow-sensing means for measuring the rate of flow of said charge stock to said reaction zone and developing a first process output signal representative thereof, and second flow-varying means for adjusting the rate of flow of said charge stock; (c) a first analyzer receiving a sample of said charge stock and developing a second process output signal representative of a composition characteristic thereof; (d) second flow-sensing means for measuring the rate of flow of said second hydrogen-containing vaporous phase, introduced into said process, and developing a third process output signal representative thereof, and third flow-varying means for adjusting the rate of flow of said second vaporous phase; (e) a second analyzer receiving a sample of the hydrogen-containing vaporous phase introduced into said preheating means and developing a fourth process output signal representative of the hydrogen concentration thereof; (f) third flow-sensing means for measuring the rate of flow of the hydrogen-containing vaporous phase introduced into said preheating means, in admixture with said charge stock, and developing a fifth process output signal representative of the rate of flow thereof; (g) means for sensing the pressure of the separated first hydrogen-containing vaporous phase and developing a sixth process output signal representative thereof; and, (h) comparator means (i) receiving said six process output signals and, operatively responsive thereto, (ii) generating first, second and third comparator output signals as functions thereof; said control system further characterized in that said comparator means is in communication with said first, second and third flow-varying means, via signal-transmitting means which transmit at least one of said comparator output signals to at least one of said flowing-varying means, whereby at least one of (i) the flow of said charge stock, (ii) the heat supplied to said preheating means and (iii) the flow of said second hydrogen-containing vaporous phase into said process is adjusted in response thereto, and said hydrogen/hydrocarbon mole ratio is regulated.

In another embodiment, the present invention affords a method for regulating the hydrogen/hydrocarbon mole ratio within the catalytic reaction zone of a continuous hydrocarbon conversion process in which hydrogen is consumed, and wherein: (1) a hydrocarbonaceous charge stock and hydrogen are introduced into a preheating means having external heat-supplying means operatively associated therewith; (2) the resulting heated charge stock-hydrogen mixture is reacted in said catalytic reaction zone; (3) the resulting reaction zone effluent stream is condensed and separated to provide a liquid phase and a first hydrogen-containing vaporous phase; (4) at least a portion of said first vaporous phase is recycled to said preheating means in admixture with said charge stock; and, (5) a second hydrogen-containing vaporous phase, from a source external of said process, is introduced therein and at least a portion therof is admixed with said first hydrogen-containing vaporous phase, and introduced therewith into said preheating means, which method comprises the steps of: (a) regulating the quantity of heat supplied too said preheating means by adjusting a first flow-varying means operatively associated therewith; (b) regulating the flow of said charge stock by adjusting a second flow-varying means, sensing the rate of flow of said charge stock and developing a first process output signal representative of a composition characteristic thereof; (c) introducing a sample of said charge stock into a first analyzer and developing therein a second process output signal representative of a composition characteristic thereof; (d) regulating the flow of said second hydrogen-containing vaporous phase, introduced into said process, by adjusting a third flow-varying means, sensing the rate of flow of said second hydrogen-containing vaporous phase and developing a third process output signal representative thereof; (e) introducing a sample of the hydrogen-containing vaporous phase, passing into said preheating means, into a second analyzer and developing therein a fourth process output signal representative of the hydrogen concentration thereof; (f) sensing the rate of flow of the hydrogen-containing vaporous phase passing into said preheating means and developing a fifth process output signal representative thereof; (g) monitoring the pressure of said separated hydrogen-containing vaporous phase and developing a sixth process output signal representative thereof; (h) introducing a sample of said separated liquid phase into a third analyzer and developing therein a seventh process output signal representative of a composition characteristic thereof; (i) transmitting said seven process output to comparator means and generating therein first, second and third comparator output signals as functions of said seven process output signals; and, (j) transmitting at least one of said three comparator output signals to at least one of said first, second and third flow-varying means and regulating the quantity of heat supplied to said preheating means, the flow of said charge stock and/or the flow of said second hydrogen-containing vaporous phase to control the hydrogen/hydrocarbon mole ratio within said catalytic reaction zone.

In another embodiment, directed toward processes in which a quench stream is directly introduced into the catalytic reaction zone for temperature control, the control system is additionally characterized in that (i) fourth flow-sensing means measures the rate of flow of a third hydrogen-containing vaporous phase, having fourth flow-varying means operatively associated therewith, introduced directly into said catalytic reaction zone, develops a seventh process output signal representative thereof and transmits said seventh output signal to said comparator means, and (iii) said comparator means generates said first, second and third comparator output signals and a fourth comparator output signal as functions of said seven process output signals.

These, as well as other ojbects and embodiments of our invention, will become evident to those possessing the requisite expertise in the appropriate art from the following, more detailed description thereof.

PRIOR ART

The utilization and integration of sophisticated control systems into a petroleum refining process are generally considered to be among the more recent technological innovations. However, candor compels recognition of the fact that the published literature is steadily developing its own field of art. For example, U.S. Pat. No. 3,759,820 (Cl. 208-64) discusses the systematized control of a multiple reaction zone process in response to two different quality characteristics of the ultimately desired product. In a specific illustration involving the catalytic reforming of a naphtha charge stock, the two product qualities are the octane rating and the measured liquid yield. Output signals, representative of the two product qualities are utilized to regulate the reaction zone severities in response thereto. In U.S. Pat. No. 3,751,229 (Cl. 23-253A) the reaction zone severity in a catalytic reforming unit is controlled in response to the octane rating of the effluent liquid at the reaction zone pressure.

U.S. Pat. No. 3,756,921 (Cl. 196-132) discloses a control system for a gasoline splitter column utilizing an octane monitor in combination with flow-measuring means on both the overhead stream and the bottom stream. Override means are utilized to prevent the splitter column from emptying should excessive quantities of bottoms material be produced. Similarly, U.S. Pat. No. 3,755,087 (Cl. 196-100) discloses the control of a fractional distillation column operating as a gasoline splitter, by measuring the octane rating of the overhead fraction and adjusting the reflux to the column in response thereto.

Another illustration of the control of reaction zone severity in response to the octane rating of the liquid phase effluent from a catalytic reforming process is disclosed in U.S. Pat. No. 3,649,202 (Cl. 23-253A). In this illustration, the reaction zone severity in each of three reaction vessels is individually regulated in response to the octane rating and the temperature differential across each of the reaction zones.

The control system of the present invention likewise regulates operating severity in one or more reaction zones of a hydrocarbon conversion process. However, a significant improvement is afforded in that extended utilization of the catalytic composite disposed within the reaction zone, at its optimum activity, is achieved, and maximum volumetric yield of the target product slate is realized throughout the overall economically effective catalyst life. Our technique involves controlling the hydrogen/hydrocarbon mole ratio in response to changes in feed stock and product compositions, reaction zone effluent composition and the then current life of the catalyst, in order to attain target product quality over an extended period of effective catalyst activity.

Briefly, our preferred method involves analyzing the product for a composition characteristic, the charge stock for a composition characteristic and the recycled vaporous phase for hydrogen concentration, and sensing operating variables including reaction zone temperatures, pressure, flow rates, etc. Output signals representative of these items are transmitted to computer/comparator means which generates additional output signals employ to regulate reaction zone severities, flow rates, etc.

SUMMARY OF INVENTION

A complete refinery within the petroleum industry comprises a multiplicity of hydrocarbon conversion processes integrated together for the principal purpose of attaining a particularly desired product slate. Such processes include the catalytic reforming of naphtha fractions to produce a relatively high octance liquid product, hydrocracking to produce lower molecular weight hydrocarbons, a portion of which can be utilized as the feed to the catalytic reforming unit, paraffinic dehydrogenation to produce olefins, hydrocarbon isomerization and hydrorefining for the purpose of contaminant removal, etc. Additionally, many refineries will include processes designed for the production of specific compounds finding utilization as petrochemicals. For example, aromatic isomerization to produce paraxylene, alkylation to produce alkyl-substituted aromatic hydrocarbons, etc. These processes involve hydrogen-consuming reactions, hydrogen-producing reactions, or both, and are generally effected by contacting the hydrocarbonaceous charge stock with a catalytic composite in a hydrogen-containing atmosphere at elevated temperature and pressure. In the interest of brevity, further discussion of our inventive concept, its function and the method for effecting the same, will be directed toward hydrogen-consuming processes, and specifically to the well known and thoroughly documented hydrocracking process. It is understood that such a specific discussion is not intended to limit the present invention beyond the scope and spirit of the appended claims.

In catalytic hydrocarbon conversion processes exemplified by the foregoing, the recycle of a hydrogen-rich vaporous phase, to combine with the fresh feed charge stock, is a common practice. Experience has indicated that this technique maintains a "clean" catalytic composite which promotes acceptable catalyst activity and the stability required to function effectively over an extended period of time. Whether considering a single-stage process, or a multiple-stage process, the recycled hydrogen-containing vaporous phase is obtained from the reaction zone effluent via high-pressure separation at a temperature in the range of about 60°F. to about 140°F. In a hydrogen-consuming process, such as hydrocracking, that portion of the separated reaction zone effluent, containing hydrogen is insufficient, and must be supplemented by make-up hydrogen from a suitable source external of the process — i.e., catalytic reforming which produces an abundance of hydrogen.

In addition to reaction zone temperatures, pressures and velocities, it is generally conceded that the hydrogen/hydrocarbon mole ratio of the combined feed to the reaction zone constitutes an extremely important operating variable. Constantly changing feed stock composition characteristics necessitate corresponding changes in the hydrogen/hydrocarbon mole ratio in order to maintain acceptable catalyst activity and stability. As the product quality and/or quantity changes, the reaction zone severity, principally temperature and pressure, must necessarily be adjusted. This, however, further affects the hydrogen/hydrocarbon mole ratio.

In accordance with the present control method and system, a charge stock composition characteristic is sensed and the hydrogen concentration within the vaporous phase being introduced into the reaction zone is sensed. The latter is, in a hydrogen-consuming process, partially separated hydrogen and partially make-up hydrogen from an external source. In a preferred system, a composition characteristic of the separated liquid product-containing stream is also sensed. Appropriate output signals are transmitted to a comparator/-computer which in turn generates computer output signals which are transmitted to adjust reaction zone severity (temperature and pressure), charge stock flow and the flow of the make-up hydrogen-containing vaporous phase, as required, in order to regulate the hydrogen/hydrocarbon mole ratio. As previously stated, in many hydrogen-consuming processes, the exothermicity of the reactions, which causes a significant temperature increase as the reactants traverse the catalyst, is controlled within specified limits through the use of a hydrogen quench stream. An additional process output signal, representative of the rate of flow of the quench stream, is transmitted to the comparator means. An output signal is developed therein, as a function thereof, in conjunction with the other process output signals, and is transmitted to flow-varying means by which the rate of flow of the quench stream is adjusted. Additionally, output signals which are representative of reaction zone inlet and outlet temperatures and the pressure of the vaporous phase separated from the reaction zone product effluent are transmitted to the comparator/computer means. In one embodiment, the signal responsive to the pressue of the separated liquid phase may be directly transmitted to adjust the flow rate of the make-up hydrogen introduced from the external source. In this manner, the comparator output signals are representative of all the operating variables which affect the hydrogen/hydrocarbon mole ratio, or partial pressure of hydrogen within the reaction zone, as well as the product quality and/or quantity.

Prior to the start-up of a hydrocracking process unit, or other hydrocarbon conversion process, the various operating variables are initially determined by preparing a yield estimate directed to a predictable product quality and/or quantity, based upon a relatively detailed analysis of the hydrocarbonaceous charge stock. Charge stock analyses will generally include molecular weight, gravity, boiling range and the relative concentrations of various types of hydrocarbons. The estimated required hydrogen/hydrocarbon mole ratio is calculated and the computer/comparator means is appropriately programmed to maintain the indicated mole ratio. Changes in feed stock composition characteristics are transmitted to the computer/compartor, as is the flow rate thereof. The pressure and flow rate of the recycled vaporous phase, as well as the hydrogen concentration thereof, is also transmitted to the computer/comparator. The latter back-calculates the required hydrogen/hydrocarbon mole ratio and transmits appropriate output signals to achieve the values so indicated. A later change in the product quality and/or quantity is sensed and the computer/comparator means appropriately adjusts the furnance firing to regulate reaction zone temperatures and/or to adjust the operating pressure within the reaction zone, in order to reattain the target product characteristics. The computer/-comparator means then compares the resulting hydrogen/hydrocarbon mole ratio and again transmits appropriate output signals to achieve the optimum.

HYDROCARBON ANALYZERS

The control system of the present invention utilizes at least three analyzers, two of which serve to determine composition characteristics of principally liquid streams, and the third of which determines the hydrogen concentration in that portion of the hydrogen-containing vaporous phase being introduced into the reaction zone in admixture with the charge stock. One of the hydrocarbon analyzers develops an output signal which is correlatable with, and representative of a composition characteristic of the hydrocarbonaceous charge stock. Complete details of one such hydrocarbon analyzer may be obtained upon reference to U.S. Pat. No. 3,463,613 (Cl. 23-230). As stated therein, a composition characteristic of a hydrocarbon sample can be determined by burning the same in a combustion tube under conditions which generate a stabilized cool flame. The position of the flame front is automatically detected and employed to develop a signal which, in turn, is employed to vary a combustion parameter, such as combustion pressure, induction zone temperature or air flow, in a manner which immobilizes the flame front regardless of changes in the composition characteristic of the hydrocarbon sample. The change in the combustion parameter, required to immobilize the flame front, following a change of sample composition, is correlatable with the composition characteristic change. An appropriate read-out device, connecting therewith, may be calibrated in terms of the desired identifying characteristic, such as molecular weight, boiling point, vapor/liquid ratio, etc.

The hydrocarbon analyzer is identified as comprising a stabilized cool flame generator having a servo-positioned flame front. The type of analysis afforded thereby is not a compound-by-compound analysis such as presented by instruments including mass spectrometers or vapor phase chromatographs. On the contrary, the analysis is represented by a continuous output signal which is responsive to, and indicative of hydrocarbon composition and, more specifically, is correlatable with one or more conventional identifications or specifications of petroleum products.

Other examples of cool flame generators, having servo-positioned flame fronts, and their use in analyzing hydrocarbon compositions and monitoring the same, are illustrated in U.S. Pat. Nos. 3,533,745 (Cl. 23-230), 3,533,746 (Cl. 23-230) and 3,533,747 (Cl. 23-230). It is this type of hydrocarbon analyzer which is also preferred for monitoring one or more composition characteristics of the liquid stream separated from the reaction zone productcontaining effluent.

With respect to the hydrogen concentration in the vaporous phase introduced into the reaction zone, chromatographic monitors of the gas-solid type, utilizing a bed of zeolitic molecular sieves, are suitable. Additionally, a density monitor, calibrated to mole percent hydrogen, is suitable for utilization as the analyzer. Still another suitable analyzer constitutes a differential pressure monitor which determines the partial pressure of hydrogen diffused through a hot palladium diaphragm. In any event, the two hydrocarbon analyzers and the hydrogen analyzer develop output signals representative of the composition characteristics and hydrogen concentration, which output signals are transmitted to the computer/comparator means.

COMPUTER/COMPARATOR

The present control system and method for regulating the hydrogen/hydrocarbon mole ratio utilizes computer/comparator means which receives various output signals from the stream analyzers and operating variable indicators, or transmitters, generates computer output signals and transmits the same to various controls and/or control loops within the overall process. Signals received by the computer are compared with previously-received signals to determine the actual value of the stream composition characteristics and hydrogen concentration. Preferably, the computer also determines the rate of change thereof. Additional output signals, received by the computer, represent temperatures associated with the conversion zone, or zones, the flow rate of the fresh charge stock, the flow rate of the vaporous phase introduced into the reaction zone with the charge stock, the temperature of the charge stock following heat exchange with a hot reaction zone effluent stream, the flow of total vaporus phase from the high-pressure separator and the pressure of the vaporous phase from the separator. Still other process output signals, which are transmitted to the comparator/computer means, represent the quantity of the make-up, hydrogen-containing vaporous phase introduced into the process from an external source, the quantity thereof which is combined with the reaction zone effluent vaporous phase and the quantity of the hydrogen-containing vaporous phase employed as reaction zone quench.

As hereinafter more thoroughly described with reference to the accompanying drawing, the computer/comparator, having previously been programmed to select the optimum hydrogen/hydrocarbon mole ratio, in response to all the signals received thereby, generates additional comparator output signals which are transmitted to a control loop which effects adjustment of the fuel supplied to heating means into which the reaction zone charge stream is introduced, to charge stock flow control means, to control means which adjusts the flow of the make-up, hydrogen-containing vaporous phase introduced into the process, and to control means which regulates the quantity of vaporous phase quench directly introduced into the reaction zone. Where a portion of the separated vaporours phase is removed from the process, a comparator output signal may be transmitted to control means to adjust the quantity thereof. It may be that any one, or more of the additional computer output signals will indicate that no change is then required in any of the above-described variable controls. The computer/comparator means can include the appurtenances necessary for comparing the actual values of the signals received with previously determined deviation limits and for generating adjustment signals responsive to this comparsion. For example, the practical maximum catalyst bed temperature in any given process may be critical as concerns catalyst activity and product quality. Should the comparator means indicate a trend to exceed the particularly specified limit, the appropriate adjustment signal is transmitted. This is especially of import in a hydrogen-consuming process where an increasing temperature gradient is experienced as the reactants traverse the catalyst bed. In a hydrocracking process, the maximum catalyst temperature might be set at 950°F., such that an appropriate adjustment signal is transmitted should other computer output signals tend to indicate an ultimate deviation.

BRIEF DESCRIPTION OF DRAWING

The accompanying drawing illustrates several embodiments of the present control system integrated into a single-stage hydrocracking process. The drawing comprises FIG. 1 and its continuation FIG. 1A. It is not intended, however, that our invention be unduly limited thereby beyond the scope and spirit of the appended claims. Modifications to the diagrammatic flow diagram will become evident to those having the requisite skill in the appropriate art.

The illustrated hydrocracking process is shown as a single-stage unit comprising reaction zone, or reactor 7, heat exchanger 3, charge heater 5, high-pressure separator 13, compressor bank 18, surge drum 14 and computer/comparator 95. The latter receives one or more various process output signals via instruments lines 40, 44, 98, 49, 52, 57, 62, 66, 69, 73, 80, 85, 90 and 94, generates additional computer output signals and transmits the same via instrument lines 36, 46, 58, 81 and 86. Hydrocarbon analyzer 37 receives a sample of the charge stock from line 1, develops an output signal representative of a composition characteristic thereof and transmits said output signal via instrument line 40 to computer/comparator 95. Analyzer 78 receives a sample of the recycled hydrogen-rich vaporous phase in line 2, develops an output signal representative of the hydgrogen content and transmits said signal via instrument line 80. The composition characteristics of the charge stock (line 1) and the separated liquid phase (line 16), being monitored by analyzers 37 and 91, will be determined primarily by the particular hydrogen-consuming process in which they are being used. Similarly, in a hydrocracking process, these composition characteristics will be selected on the basis of the particular type of charge stock and the product slate intended to be produced therefrom. As a result, the anaylzers may, or may not be identical.

Figure 1:
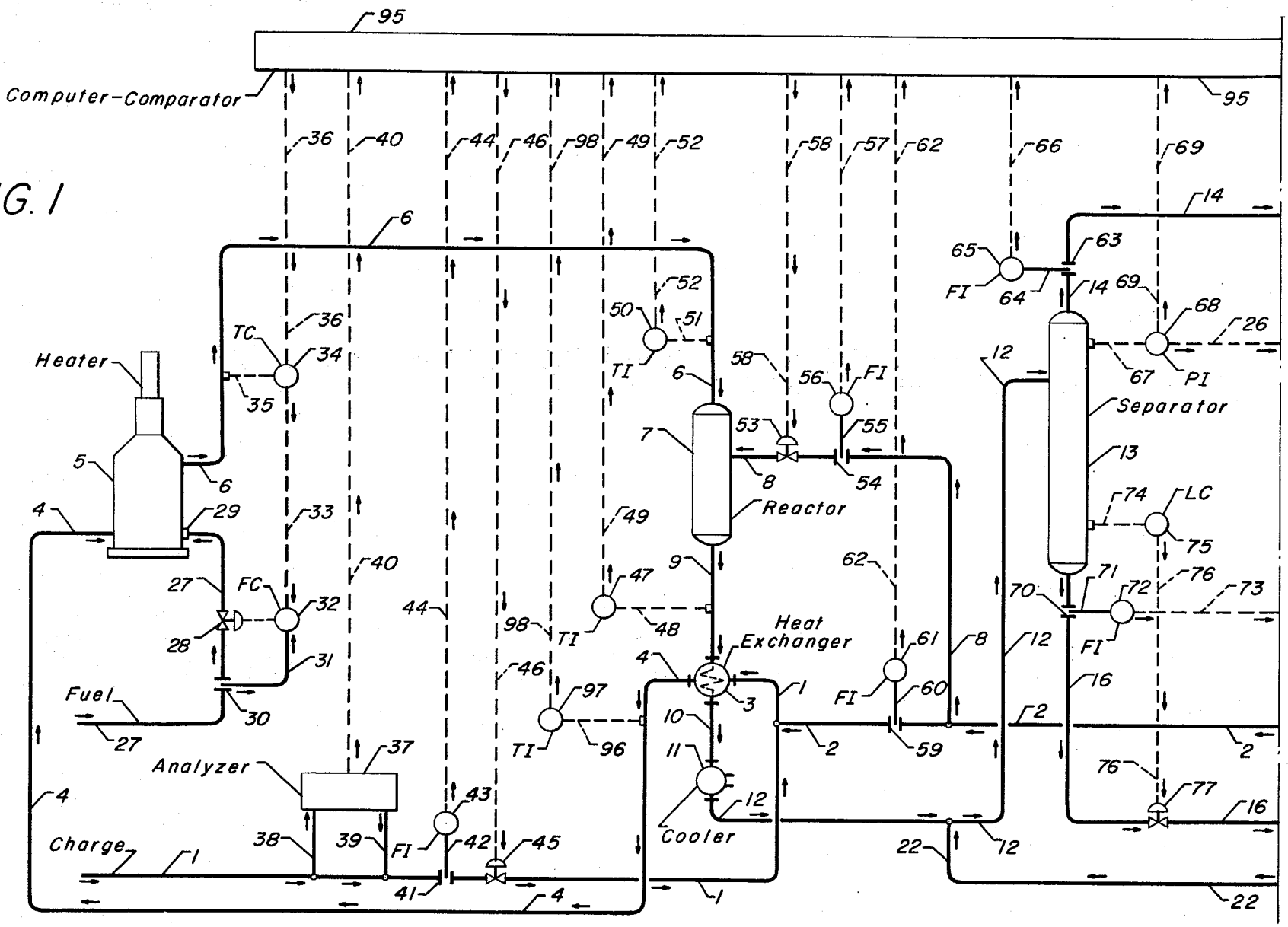
Figure 1A:
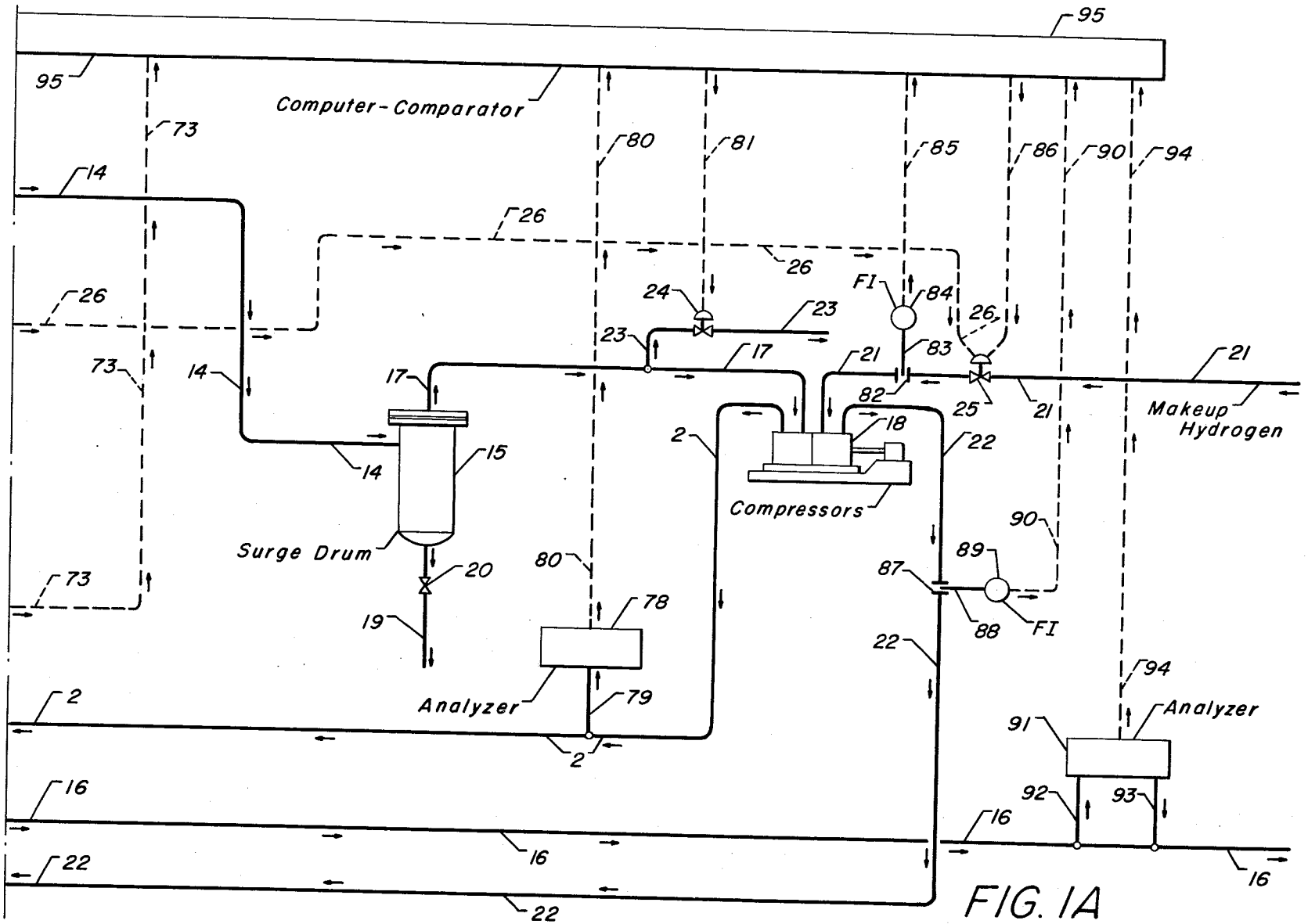

Hydrocarbon analyzers 37 and 91, which receive samples of the hydrocarbonaceous feed stock and the separated liquid phase, respectively, may utilize stabilized cool flame generators having a servo-positioned flame front. The flow of oxidizer (air) and fuel (the sample being received) are fixed, as is the induction zone temperature. Combustion pressure is the parameter which is varied in order to immobilize the cool flame front. When a change in the selected composition characteristic is experienced, the change in combustion pressure required to immobilize the flame front provides a signal which is a direct, corollatable indication of the change. Common operating conditions for these hydrocarbon analyzers are: air flow, 3,500 cc./min. (STP); fuel flow, 1.0 cc./min.; an induction zone temperature in the range of about 650°F. to about 825°F.; and a varying combustion pressure of about 4.0 to about 20.0 psig.

Where, for example, the hydrogen-consuming process is hydrocracking, wherein the desired result is maximum production of gasoline boiling range hydrocarbons from heavier material, the analyzer may take the form of a vapor/liquid ratio analyzer similar to that described in U.S. Pat. No. 3,491,585 (Cl. 73-53). In situations where the charge stock is intended for LPG (liquefied petroleum gas) predominating in propane and butane, a boiling point monitor, or chromatographic analyzers might be utiized. The sample is flashed into the carrier stream, generally helium, and conveyed thereby into the chromatographic column. The column impedes the passage of the materials in the sample as a function of their boiling points and carbon chain lengths. As the carrier gas leaves the column and is introduced into the detector, it carries with it components in sequential order according to their respective boiling points.

In order to effect control of the hydrogen/hydrocarbon mole ratio, the concentration of hydrogen in the vaporous phase being admixed with the fresh feed charge stock must be known. Thus, analyzer 78 develops a process output signal which is representative of the hydrogen content of the vaporous phase in line 2. The sample is introduced by way of line 79, and the representative output signal transmitted via line 80. As hereinbefore stated, analyzer 78 is only required to produce a process output signal representative of the hydrogen concentration; therefore, it may be selected from a variety of suitable devices described in the appropriate art.

As previously set forth, hydrocracking is effected in one or more fixed-bed catalytic reaction zones, depending upon the product slate desired from a given feed stock. For example, U.S. Pat. No. 3,718,575 (Cl. 208-59) describes a multiple-stage hydrocracking process for LPG production. The charge stock boils above the gasoline boiling range, for example, a full boiling range gas oil having an initial boiling point of about 500°F. and and end boiling point above 1,000°F. In its virgin state, such a feed stock will contain contaminants in the form of nitrogenous and sulfurous compounds, and will, therefore, be subjected initially to hydrorefining whereby these deleterious contaminating influences are converted into ammonia, hydrogen sulfide and hydrocarbons. Hydrorefining is one of the hydrogen-consuming processes into which the control system of our invention can be advantageously integrated.

Hydrocracking reactions are effected at catalyst bed temperatures in the range of about 650°F. to about 950°F., and preferably from about 700°F. to about 900°F. The reaction zones are maintained under an imposed pressure of about 500 to about 5,000 psig., generally with an upper limit of about 2,500 psig. The rate of hydrocarbon charge stock flow will be from 0.25 to about 5.0 liquid hourly space velocity, and the hydrogen concentration will range from 3,000 to about 50,000 scf./Bbl. Of all the hydrogen-consuming processes, hydrocracking exhibits the greater degree of exothermicity. Therefore, in order to control the increasing temperature gradient, as the reactants traverse the catalyst bed, a quench stream, generally hydrogen-containing, will be introduced directly into the catalyst bed at one or more intermediate loci thereof.

The selection of the catalytic composite, for utilization in the hydrocracking reaction zones, is principally determined following a detailed analysis of the fresh feed charge stock and desired product yield estimate founded thereon, and is directed toward the product quality and quantity. Generally, although the catalytic composite is "tailored" for its intended use, it will comprise at least one metallic component selected from Groups VI-B and VIII of the Periodic Table, rhenium, tin and germanium, which are combined with a siliceous refractory material containing from about 12.0% to about 30.0% by weight of alumina. Appropriate prior art indicates an apparent preference for a catalyst where the metallic components are impregnated, or ion-exchanged onto a crystalline aluminosilicate molecular sieve, a variety of which are commonly referred to by the broad term "zeolites." One such catalyst, which exhibits the desired characteristics of activity and stability, is a composite, for example, of about 5.3% by weight of nickel and a synthetically-prepared faujasite which is distributed throughout a silica matrix. Other suitable zeolitic materials include mordenite, Type X or Type Y molecular sieves, as well as zeolitic material which is dispersed within an amorphous matrix of alumina, silica or aluminasilica. It is understood that the precise composition of the catalytic composite employed in hydrocracking, or in any of the previously delineated conversion processes, wherein hydrogen is consumed, does not constitute a feature essential to our invention. Furthermore, it is not intended to limit our invention to a process having a specific number of individual reaction zones. Thus, although our invention is illustrated as a single-stage process, in the accompanying drawing, it is readily adaptable to a two-stage, or three-stage process.

As comprehension and understanding of the catalytic reaction mechanisms involved in hydrogen-consuming processes, and particularly hydrocracking, increased, it became possible to correlate operating techniques and conditions with specific catalyst compositions, consistent with charge stock properties to enhance the attainment of the target product quality and quantity. While the intended hyrocracking function is the same in all situations, to "crack" higher molecular weight hydrocarbon into lower molecular weight hydrocarbons, it is necessary to select operating conditions and techiques which will prolong the acceptable, effective period during which the selected catalyst performs its intended function. Problems and difficulties attendant the control of a hydrocracking process, in order to judiciously promote the effective catalyst life — generally defined as barrels of fresh charge stock per pound of catalyst within the reaction zone — are considerably more perplexing than in many other hydrocarbon conversion processes, particularly those which are categorized as hydrogen-producing. Some of these problems have been at least partially alleviated by the incorporation of various process techniques. For example, where the increasing temperature gradient is excessive, direct quench streams are employed; also, charge stock diluents, generally of lower boiling range are somewhat effective.

Significant problems and difficulties remain, and stem from a myriad of aspects including a constantly changing fresh charge stock composition, with its accompanying effect upon the desired product slate and the required changes in reaction zone severity. This is compounded by the fact that a common technique involves recycling that portion of the product effluent which boils at temperatures above the desired product — i.e., when producing naphtha boiling range liquid product, that portion of the effluent boiling above about 390°F. is recycled. Varying compositions of the total reaction zone effluent further affect product quality and quantity, and the severity of operation within the reaction zone as a result of the varying compositions of the vaporous and liquid phases separated within the high-pressure separator. Additionally, the introduction of the quench stream, or streams directly into the catalyst disposed within the reaction zone becomes a contributing factor respecting process control. Also to be considered is the normal deterioration of the active components within the catalytic composites, the rate of which is partially decelerated through the use of recycled hydrogen in amounts based upon the flow of fresh charge stock.

In view of the foregoing, continuously meeting target product quality and quantity, while simultaneously extending the effective life of the selected catalytic composite remains a dilemma which plagues the refiner. Controlling the hydrogen/hydrocarbon mole ratio in accordance with the present invention effectively solves the problems and thus avoids the attendant difficulties.

DETAILED DESCRIPTION OF DRAWING

Our method for controlling the hydrogen/hydrocarbon mole ratio in a catalytic hydrocarbon conversion process wherein hydrogen is consumed, and the control system therefor, will be more clearly understood with reference to the accompanying diagrammatic sketch. Although the drawing is directed toward a single-stage, fixed-bed catalytic process, it is equally well suited for multiple-stage hydrogen-consuming processes hereinbefore delineated. Furthermore, while the descriptive illustration is directed toward the production of LPG from naphtha boiling range hydrocarbons, it is obviously not the intention to limit our invention thereto. In the drawing, process flow lines, including sample taps, and major items of equipment are therein illustrated by solid lines, while the dashed lines represent signal-transmitting means to and from the computer/comparator and in the indicated cascade control loops. The drawing will be described in conjunction with a commercially-scaled unit designed to produce maximum quantities of a propane/butane concentrate from 10,200 Bbl./day of a comparatively light naphtha fraction having a gravity of 64.0 °API, an initial boiling point of about 175°F. and an end boiling point of about 248°F.

With specific reference now to the drawing, 1016.0 moles/hr. of the fresh naphtha charge stock is introduced into the process by way of line 1, in admixture with 548.7 moles/hr. of a recycled pentane-plus liquid stream, the source of which is hereinafter described. A hydrogen-rich, principally vaporous phase in line 2, in the amount of 9,981.5 moles/hr. (79.3% hydrogen) is admixed therewith, the mixture continuing through line 1 into heat-exchanger 3. Heat-exchanger 3 is an indirect heat exchanger generally of the tube and shell type; the hydrogen/hyrocarbon mixture is introduced thereto at a temperature of about 161°F. and a pressure of about 1155 psig. The heating medium is relatively hot reaction zone effluent introduced into the heat exchanger via line 9. The thus-preheated mixture is introduced, via line 4, at a temperature of about 610°F. and a pressure of about 1125 psig., into a direct-fire furnance heater 5. Although heater 5 may be any type of heat exchanger employing various heating media such as steam, hot oil, hot vapor, flue gas, etc. in order to achieve the high temperature required, the heater will generally be a direct-fire furnance as illustrated.

The heated reaction mixture is withdrawn from direct-fire heater 5 by way of line 6, and introduced thereby into a fixed-bed reaction zone 7, at a temperature of about 650°F. and a pressure of about 1090 psig. In this illustration, the catalytic composite disposed within reaction zone 7 contains about 5.0% by weight of a nickel component (calculated as the elemental metal) combined with a carrier material of synthetic faujasite interspersed throughout a silica matrix. As hereinbefore stated, since the principal reaction is hydrocracking which exhibits a relatively high degree of exothermicity, an increasing temperature gradient will be experienced as the reactant stream traverses the catalyst bed. In this particular instance, operating techniques dictate a maximum temperature increase of about 100°F. Therefore, a hyrogen-rich stream is introduced, via line 8, intermediate the reaction zone at a temperature of about 120°F. The effluent from reactor 7 passes through line 9 into heat exchanger 3 wherein it is utilized as the heating medium to preheat the fresh feed charge stock and recycled hydrogen prior to the introduction thereof and to direct-fired heater 5. Following heat-exchange, the reaction zone effluent in line 10 is introduced into cooler 11 at a temperature of about 223°F. and a pressure of about 1015 psig. The thus-cooled reaction zone effluent is introduced via line 12 into high-pressure separator 13 at a temperature of about 100°F. and a pressure of about 1000 psig.

A principally vaporous phase is withdrawn from separator 13 by way of line 14, and introduced therethrough into surge drum 15. The LPG-rich principally liquid phase is withdrawn by way of line 16 and introduced thereby into suitable separation facilities for the removal therefrom of vaporous material, principally hydrogen, methane and ethane, and hydrocarbons containing more than about four carbon atoms per molecule. The latter, in an amount of about 548.7 moles/hour, is recycled to combine with the charge stock in line 1, prior to the sample thereof being introduced into analyzer 37. The final product, in an amount of about 12,800 Bbl./day (1942 moles/hr.) contains about 99.1% propane and mixed butanes. Surge drum 15 serves to remove entrained normally liquid material from the separated vaporous phase in line 14, which material is periodically withdrawn by way of line 19 containing valve 20. The remaining vaporous phase is withdrawn by way of line 17 and introduced thereby into compressor bank 18 for recycle through line 2 to line 1 wherein it is admixed with the hydrocarbon charge stock and introduced into heat exchanger 3. At least a portion of the recycle vaporous phase in line 2 is diverted by way of line 8, being introduced thereby directly into reaction zone 7 as the quench stream.

Make-up hydrogen, to supplement that consumed within reaction zone 7, is introduced into the process via line 21; the hydrogen concentration approximates 85.0% (on a mole basis). This supplemental hydrogen-rich stream is discharged via compressor bank 18 through line 22, from which it is admixed with the cooled reaction zone product effluent in line 12 for introduction thereby into high-pressure separator 13. Situations will arise where judicious operating techniques dictate the removal of a portion of the recycle vaporous phase in line 17 through line 23 containing control valve 24. Although control valve 24 may function in response to a computer output signal being transmitted thereto via instrument line 81 (as illustrated), it may be adjusted by transmitting the signal from pressure transmitter 68 directly (not illustrated). Similarly, control valve 25, in make-up hydrogen line 21, can either be adjusted via a computer output signal from instrument line 86, or directly in response to the signal transmitted via line 26 from pressure indicator 68. Those possessing the requisite skill in the appropriate art will, obviously, recognize that both control valve 24 and control valve 25 might receive output signals in a given situation.

Withdrawal of the principally liquid phase, from high pressure separator 13 via line 16, is adjusted and controlled through the use of a liquid-level control system consisting of level-sensing means transmitting a level output signal via instrument line 74 to level controller 75 which, in turn, regulates the operation of control valve 77 by transmitting an appropriate signal through instrument line 76. The level-sensing means may be a floating lever mechanism, a dielectric probe, a DP cell, or any similar device capable of maintaining a preset liquid level seal in the lower portion of high-pressure separator 13.

In the illustrated hydrocracking embodiment, hydrocarbon analyzer 91 is adapted to function as a boiling point monitor. A sample loop connects analyzer 91 with the normally liquid separator bottoms material in line 16, and consists of line 92 which removes a sample at a rate of about 100 cc. per minute, and line 93 which returns excess sample at a rate of about 99 cc. per minute. The sample itself is drawn off the analyzer from some intermediate portion of the sample loop and injected at full line pressure and a carefully controlled rate of 1.0 cc. per minute. The output signal can be, and preferably is calibrated in terms of boiling points, and transmitted via line 94 to computer/comparator 95 which is operatively responsive to the boiling point output signal, and which, in turn develops a comparator output signal as a function thereof.

In order to effect optimum control of the hydrogen/hydrocarbon ratio within the reaction zone, computer/comparator 95 receives a number of other output signals, in addition to that representative of the composition characteristic of the separated liquid phase in line 16, which other process output signals are indicative of operating conditions within the process and other composition characteristics. Process output signals, or input signals to computer/comparator 95, include one which is representative of at least one composition characteristic of the hydrocarbonaceous charge stock in line 1. A 100 cc. per minute sample of the feed stock is withdrawn through line 38 and introduced into hydrocarbon analyzer 37, the excess being returned via line 39. suitable composition characteristics, with which the process output signal is correlatable, include boiling point, molecular weight, density, etc. Of these, the molecular weight of the feed stock is preferred since changes therein will have the greatest bearing upon the desired product slate and the hydrogen/hydrocarbon mole ratio. It is, of course, within the scope of our inventive control system to utilize a plurality of analyzers in order to monitor several charge stock characteristics. Thus, instrument line 40 will transmit onee or more output signals representative of one or more charge stock composition characteristics. Of course, the more processing output signals transmitted to computer/comparator 95, the closer the control of the hydrogen/hydrocarbon mole ratio.

As hereinbefore set forth, the concentration of hydrogen within the vaporous phase being recycled to direct-fired heater 5, in admixture with the charge stock in line 1, must be known. Thus, analyzer 78 develops a process output signal representative of, and correlatable with the hydrogen content in the vaporous phase in line 2. The sample is introduced by way of line 79, and the representative output signal transmitted to computer/comparator 95 by way of line 80. Since analyzer 78 is only required, in this illustration, to produce a process output signal representative of the hydrogen concentration, it may be selected from a variety of suitable devices described in the appropriate prior art.

Other process output signals, developed and transmitted to computer/comparator 95, involve operating variables, and are utilized to further refine the present control system and thus enhance the overall operation of the hydrogen-consuming process. One principal operating variable is the pressure at which the vaporous phase is separated from the reaction zone effluent in high-pressure separator 13. The output signal representative thereof is sensed, via line 67, by pressure indicator 68, and transmitted to computer/comparator 95 through instrument line 69. Additionally, flow indicator 43 senses the rate of flow of charge stock through line 1, by way of line 42, as metered by a flow-determining means 41, the latter being a venturi, orifice, turbine meter, or other suitable device. The output signal representative of the rate of flow of charge stock is transmitted via instrument line 44. Likewise, the rate of flow of the hydrogen-rich vaporous phase, being recycled via line 2, is measured and sensed by flow-determining means 59, line 60 and flow indicator 61; the output signal is transmitted by way of line 62.

Although not essential to the present hydrogen/hydrocarbon mole ratio control system, but preferred from the viewpoint of overall process operation, are the flow rates of the liquid and vapor phases separated in high-pressure separator 13. The former is measured by flow-determining means 70, transmitted via line 71 to flow indicator 72, the output signal from which is transmitted via line 73 to computer/comparator 95. The flow rate of the vaporous phase, separated and withdrawn through line 14, is measured by flow-determining means 63 which transmits a signal via line 64 to flow indicator 65, the output signal from which is, in turn, transmitted to computer/comparator 95 by way of instrument line 66.

Other output signals, indicative of processing conditions employed within the illustrated conversion process, are representative of various temperatures therein. One such temperature is that of the combined feed stream which is preheated in heat exchanger 3, and introduced into direct-fired heater 5 through line 4. The temperature of the preheated stream is sensed via line 96 and temperature indicator 97. The latter transmits a representative output signal to computer/-comparator 95 via instrument line 98. The inlet and outlet temperature across the reaction zone is sensed, and appropriate signals transmitted to the computer/-comparator. As previously stated, the temperature differential (delta-T) across the catalyst bed is an important variable, in a hydrogen-consuming process, with respect to product specifications and catalyst activity and stability. The delta-T across the catalyst bed in reactor 7 is determined by the inlet temperature sensed by temperature-sensing means 51 and temperature indicator 50, and the outlet temperature sensed by temperature-sensing means 48 and temperature indicator 47; the representative output signals are transmitted through instrument lines 52 and 49, respectively. It is understood that pressure indicator 68 and temperature indicators 50, 47 and 97 may operate "blind". That is, they may simply transmit their respective output signals, and not simultaneously register the measurement on some control panel.

Still other process output signals, which further enhance the operation of the illustrated control system and thus the overall operation of the process, include that which is representative of the rate of flow of make-up hydrogen being introduced by way of line 21; this is metered by flow-determining means 82 wich transmits the appropriate signal to flow indicator 84, by way of line 83, the latter in turn transmitting the output signal by way of line 85. Similarly, the flow rate of that portion of the make-up hydrogen stream through line 22, to be admixed thereby with the reaction product effluent in line 12, is metered by way of flow-determining means 87, line 88 and flow indicator 89; the appropriate output signal representative thereof being transmitted to computer/comparator 95 by way of instrument line 90. One of the functions of computer/comparator 95 is to determine the quantity of hydrogen quench being diverted from line 2 by way of line 8 directly into the catalyst bed disposed within reactor 7. The flow rate thereof is determined by flow-metering means 54, line 55 and flow indicator 56, the latter transmitting the appropriate process output signal by way of instrument line 57.

Computer/comparator 95 is internally programmed to be responsive to the various process output signals thus developed, and to develop and generate computer output signals which are utilized to make the necessary adjustments within the process in order to control the hydrogen/hydrocarbon mole ratio consistent with liquid product quality and quantity, and thus maintain an extended period of acceptable catalyst activity. The computer output signal transmitted by way of instrument line 36 is generated in a manner sufficient to adjust the temperature level within reaction zone 7. Heat input to reaction zone 7 is provided by introducing a suitable combustible fuel into direct-fired heater 5. The fuel, which may be liquid, gas, or a mixture thereof, is burned within the combustion zone, and the hot combustion gases pass through the furnace and out the refinery stack. Heat input to the reactant mixture is controlled by adjusting the rate of fuel flow to heater 5, wherein the fuel is introduced via line 27 and combustion nozzle 29. The control thereof is achieved by a flow-control loop comprising flow sensing means 30 — i.e., a turbine meter —, control valve 28, flow controller 32 and flow signal line 31 which transmits the flow signal from sensing means 30 to controller 34. Flow controller 32, which is equipped with an automatically adjustable setpoint, then transmits an appropriate adjustment signal to control valve 28.

In addition to the flow-control loop provided in the fuel introduction system of direct-fired heater 5, there is preferably associated therewith, in cascade fashion, a temperature recorder-controller also having an automatically adjustable setpoint, and which senses the temperature of the reactant mixture as it emanates from the direct-fired heater. There is shown thermocouple means 35, contained in reactor inlet line 6, transmitting a temperature signal to temperature controller 34. Controller 34 produces an output signal which is transmitted by way of line 33 to flow controller 32 to adjust, or reset the automatically adjustable setpoint thereof. Temperature controller 34, also having an adjustable setpoint, receives the appropriate computer output signal via line 35. Computer/comparator 95 thus adjusts the temperature associated with reactor 7 by resetting the setpoint of temperature controller 34 which, in turn, resets the automatically adjustable setpoint of flow controller 32.

In addition to the comparator output signals above described, provision is made within the computer program to regulate the fresh feed charge stock flow rate, the flow rate of the hydrogen-rich recycled vaporous phase, the flow rate of the quench stream introduced directly into the reaction zone and the quantity of make-up hydrogen removed from the process through line 25. Flow indicator 43 transmits a process output signal, representative of the charge stock flow rate, to computer/comparator 95 by way of instrument line 44. This signal is considered in determining the required adjustments to achieve the then best hydrogen/hydrocarbon mole ratio, and an appropriate computer output signal is transmitted by way of instrument line 46 to adjust flow control valve 45, thereby either increasing, or decreasing the flow of charge stock through line 1. Similarly, the flow rate of the recycled gaseous phase admixed with the charge stock in line 1 is sensed by flow indicator 59, and a representative signal is developed and transmitted to the computer/comparator via line 62. This signal is considered in conjunction with that representative of the separator pressure, being sensed by pressure indicator 68, and is conjunctively employed to develop a computer output signal in line 86. These process output signals are also conjunctively considered by computer/comparator 95, and may simultaneously regulate the operation of control valve 24 by way of instrument line 81. A comparator output signal is also transmitted by way of instrument line 58 to regulate control valve 53 which is turn increases, or decreases the quantity of the quench stream introduced by way of line 8. With respect to the quantity of make-up hydrogen introduced via line 22 and control valve 25, the principal output signals to which the computer/-comparator responds are those transmitted thereto by way of instrument lines 57, 66, 62, 85 and 90.

From the foregoing discussion, the method by which the present control system is effected is readily apparent to those having the requisite expertise in the appropriate art. Also, the benefits and numerous advantages will be easily recognized. Principal among the advantages is the continuous monitoring which enhances catalyst stability and maintains catalyst activity by controlling reaction zone hydrogen/hydrocarbon mole ratio at that current optimum consistent with product quality and quantity. Prior art control systems which monitor only a composition characteristic of the separated, product-containing liquid phase, and adjust only the reaction zone severity (principally temperature) in response thereto, must necessarily accept whatever effective catalyst activity and stability results. To the contrary, the present control system focusses upon hydrogen/hydrocarbon mole ratio to enhance catalyst stability, or extend the period of time that the catalyst functions acceptably, while simultaneously attaining the desired product slate. Our invention recognizes the necessity of additionally monitoring characteristics of the charge stock and its ratee of flow, as well as the flow and hydrogen content of the various vaporous phases within the overall process.

We claim as our invention:

1. In a continuous hydrocarbon conversion process in which hydrogen is consumed, and where (1) a hydrocarbonaceous charge stock and hydrogen are introduced into preheating means having external heat-supplying means operatively associated therewith; (2) the resulting heated charge stock hydrogen mixture is reacted in a catalytic reaction zone; (3) the resulting reaction zone effluent stream is condensed and separated to provide a liquid phase and a first hydrogen-containing vaporous phase; (4) at least a portion of said first vaporous phase is recycled to said preheating means, in admixture with said charge stock; (5) a second hydrogen-containing vaporous phase, from an external source, is introduced into said process, at least a portion thereof is admixed with said first hydrogen-containing vaporous phase and introduced therewith into said preheating means, and (6) at least a portion of said first hydrogen-containing vaporous phase is introduced directly into said reaction zone as a third hydrogen-containing vaporous phase; the control system for regulating the hydrogen/hydrocarbon mole ratio within said reaction zone which comprises, in cooperative combination:

a. first flow-varying means, operatively associated with said preheating means, for adjusting the quantity of heat supplied thereto;

b. first flow-sensing means for measuring the rate of flow of said charge stock to said reaction zone and developing a first process output signal representative thereof, and second flow-varying means for adjusting the rate of flow of said charge stock;

c. a first analyzer receiving a sample of said charge stock and developing a second process output signal representative of a composition characteristic thereof;

d. second flow-sensing means for measuring the rate of flow of said second hydrogen-containing vaporous phase, introduced into said process, and developing a third process output signal representative thereof, and third flow-varying means for adjusting the rate of flow of said second vaporous phase;

e. a second analyzer receiving a sample of the hydrogen-containing vaporous phase introduced into said preheating means and developing a fourth process output signal representative of the hydrogen concentration thereof;

f. third flow-sensing means for measuring the rate of flow of the hydrogen-containing vaporous phase introduced into said preheating means, in admixture with said charge stock, and developing a fifth process output signal representative of the rate of flow thereof;

g. means for sensing the pressure of the separated first hydrogen-containing vaporous phase and developing a sixth process output signal representative thereof;

h. fourth flow sensing means for measuring the rate of flow of said third hydrogen-containing vaporous phase and a fourth flow-varying means operatively associated therewith, said fourth flow sensing means developing a seventh process output signal representative of the rate of flow thereof;

i. a third analyzer receiving a sample of said liquid phase and developing an eighth process output signal, said eighth process output signal representative of the composition characteristic of said liquid phase; and j. comparator means (i) receiving said eight process output signals and, operatively responsive thereto, (ii) generating first, second, third and fourth comparator output signals as functions thereof; said control system further characterized in that said comparator means is in communication with said first, second, third and fourth flow-varying means, via signal-transmitting means which transmit at least one of said comparator output signals to at least one of said flow-varying means, whereby at least one of (i) the flow of said charge stock, (ii) the heat supplied to said preheating means, (iii) the flow of said second hydrogen-containing vaporous phase into said process and (iv), the flow of said third hydrogen-containing vaporous phase into said catalytic reaction zone is adjusted in response thereto, and said hydrogen/hydrocarbon mole ratio is regulated.

2. The control system of claim 1 further characterized in that said first and third analyzers comprise stabilized cool flame generators having servo-positioned flame fronts.

3. The control system of claim 1 further characterized in that first temperature-sensing means senses a first temperature within said reaction zone, develops a ninth process output signal representative thereof and transmits said ninth output signal to said comparator means.

4. The control system of claim 3 further characterized in that said comparator means generates an output signal as a function of said first reaction zone temperature and the composition characteristic of said separated liquid phase, and transmits said output signal to said first flow-varying means whereby the heat supplied to said preheating means is adjusted in response thereto.

5. The control system of claim 3 further characterized in that second temperature-sensing means senses a second temperature within said reaction zone, develops a tenth process output signal representative thereof and transmits said tenth output signal to said comparator means.

6. The control system of claim 5 further characterized in that said comparator means generates a comparator output signal as a function of said first and second reaction zone temperatures, and the composition characteristic of said separated liquid phase, and transmits said comparator output signal to said first flow-varying means whereby the heat supplied to said preheating means is adjusted in response thereto.

7. The control system of claim 5 further characterized in that said first temperature-sensing means senses a first temperature in the outlet section of said reaction zone, said second temperature-sensing means senses a second temperature in the inlet section of said reaction zone, the developed ninth and tenth output signals are transmitted to said comparator means and said comparator means generates a comparator output signal as a function of the difference between said first and second temperatures, and the composition characteristic of said separated liquid phase, and said comparator output signal is transmitted to said first flow-varying means.

8. The control system of claim 6 further characterized in that said first flow-varying means comprises a flow control loop having a flow controller with an adjustable setpoint regulating the supply of heat to said preheating means, said setpoint being adjusted in response to said comparator output signal.

9. The control system of claim 8 further characterized in that (i) temperature-controlling means, having an adjustable setpoint, develops a controller output signal representative of the heated charge stock-hydrogen mixture from said preheating means and transmits said controller output signal to said flow controller, whereby the setpoint thereof is adjusted in response thereto, and (ii) said comparator output signal is transmitted to said temperature-controlling means, whereby the setpoint thereof is adjusted in response thereto.

10. The control system of claim 1 further characterized in that said comparator means generates a fifth comparator output signal as a function of said sixth process output signal and transmits said fifth comparator output signal to fifth flow-varying means operatively associated with said first hydrogen-containing vaporous phase whereby a portion thereof is withdrawn from said process.

11. A method for regulating the hydrogen/hydrocarbon mole ratio within the catalytic reaction zone of a continuous hydrocarbon conversion process in which hydrogen is consumed, and wherein: (1) a hydrocarbonaceous charge stock and hydrogen are introduced into preheating means having external heat-supplying means operatively associated therewith; (2) the resulting heated charge stock-hydrogen mixture is reacted in said catalytic reaction zone; (3) the resulting reaction zone effluent stream is condensed and separated to provide a liquid phase and a first hydrogen-containing vaporous phase, (4) at least a portion of said first vaporous phase is recycled to said preheating means, in admixture with said charge stock; (5) a second hydrogen-containing vaporous phase, from a source external of said process, is introduced therein and at least a portion thereof is admixed with said first hydrogen-containing vaporous phase, and introduced therewith into said preheating means, and (6) at least a portion of said first hydrogen-containing vaporous phase is introduced directly into said reaction zone as a third hydrogen-containing vaporous phase which method comprises the steps of:

a. regulating the quantity of heat supplied to said preheating means by adjusting a first flow-varying means operatively associated therewith;

b. regulating the flow of said charge stock by adjusting a second flow-varying means, sensing the rate of flow of said charge stock and developing a first process output signal representative thereof.

c. introducing a sample of said charge stock into a first analyzer and developing therein a second process output signal representative of a composition characteristic thereof;

d. regulating the flow of said second hydrogen-containing vaporous phase, introduced into said process, by adjusting a third flow-varying means, sensing the rate of flow of said second hydrogen-containing vaporous phase and developing a third process output signal representative thereof;

e. introducing a sample of the hydrogen-containing vaporous phase, passing into said preheating means, into a second analyzer and developing therein a fourth process output signal representative of the hydrogen concentration thereof;

f. sensing the rate of flow of the hydrogen-containing vaporous phase passing into said preheating means and developing a fifth process output signal representative thereof;

g. monitoring the pressure of said separated first hydrogen-containing vaporous phase and developing a sixth process output signal representative thereof;

h. introducing a sample of said separated liquid phase into a third analyzer and developing therein a seventh process output signal representative of a composition characteristic thereof;

i. regulating the flow of said third hydrogen-containing vaporous phase by adjusting a fourth flow-varying means, sensing the rate of flow of said third hydrogen-containing vaporous phase and developing an eighth process output signal representative thereof;

j. transmitting said eight process output signals to comparator means and generating therein first, second, third and fourth comparator output signals as functions of said eight process output signals; and, k. transmitting at least one of said four comparator output signals to at least one of said first, second, third and fourth flow-varying means and regulating the quantity of heat supplied to said preheating means, the flow of said charge stock, the flow of said second hydrogen-containing vaporous phase and/or the flow of said third hydrogen-containing vaporous phase directly into said catalytic reaction zone to control the hydrogen-hydrocarbon mole ratio within said catalytic reaction zone.

12. The method of claim 11 further characterized in that said hydrocarbon conversion process is hydrocracking and said first analyzer develops a process output signal representative of the molecular weight of said charge stock.

* * * * *